United States Patent [19]

Ichikawa et al.

[11] 4,216,649

[45] Aug. 12, 1980

[54] FUNCTION SELECTION CIRCUIT FOR MULTI-FUNCTION TIMEPIECE

[75] Inventors: Singo Ichikawa, Sayama; Fujio Ishida, Kodaira; Hideyuki Kawashima, Higashikurume, all of Japan

[73] Assignee: Citizen Watch Company Limited, Tokyo, Japan

[21] Appl. No.: 811,501

[22] Filed: Jun. 30, 1977

[30] Foreign Application Priority Data

Jul. 6, 1976 [JP] Japan ..... 51/80154

[51] Int. Cl.[2] ..... G04B 19/24; G04F 8/00; G04B 27/00

[52] U.S. Cl. ..... 368/109; 368/10; 368/29; 368/101; 368/185

[58] Field of Search ..... 58/4 A, 23 R, 50 R, 58/57, 58, 152, 57.5, 39.5, 74, 38, 38 R; 235/92 T; 324/181, 186, 187; 328/41

[56] References Cited

U.S. PATENT DOCUMENTS

| | | | |
|---|---|---|---|
| 3,852,950 | 12/1974 | Yada et al. | 58/4 A |
| 3,953,964 | 5/1976 | Suppa et al. | 58/50 R |
| 4,033,108 | 7/1977 | Bennett et al. | 58/50 R |
| 4,044,544 | 8/1977 | Yagi et al. | 58/50 R |
| 4,059,955 | 11/1977 | Prak | 58/85.5 |
| 4,074,513 | 2/1978 | Donze et al. | 58/58 |
| 4,083,175 | 4/1978 | Petropoulos et al. | 58/58 |

*Primary Examiner*—Edith S. Jackmon
*Attorney, Agent, or Firm*—Jordan and Hamburg

[57] ABSTRACT

A function selection circuit for multi-function timepiece which has a timekeeping circuit, a display device to display output data from the timekeeping circuit, and a function circuit to provide a plurality of functions which can be selected by an external control member in a predetermined sequence. The function selection circuit has a circuit means controlled by the external control member to provide an output to enable a selection of time correction mode from said plurality of functions in the predetermined sequence.

11 Claims, 5 Drawing Figures

| Fig. 2 A | Fig. 2 B |
|---|---|

FUNCTION SELECTION CIRCUIT FOR MULTI-FUNCTION TIMEPIECE

BACKGROUND OF THE INVENTION

This invention relates to a multi-function timepiece equipped with an alarm function as well as other functions.

In digital electronic timepieces comprising C-MOS circuits and electro-optical display means and which adopt a quartz controlled oscillator as a time standard, the C-MOS function circuits are easy to construct and the display means may be used to display a number of functions. For this reason, large numbers of so-called function timepieces have been proposed and put into production. One example of such is an electronic timepiece having an alarm, i.e., a timepiece equipped with a sound generator and alarm memory circuit.

SUMMARY OF THE INVENTION

An object of the invention is the provision of an electronic timepiece equipped with a function selection circuit adapted to provide a plurality of output signals to select a plurality of function modes in a function circuit in a predetermined sequence by the actuation of an external control member.

These and other objects, features and advantages of the present invention will become more apparent from the following description when taken in conjunction with the accompanying drawings, in which:

DESCRIPTION OF THE PREFERRED EMBODIMENTS

Figure 1:
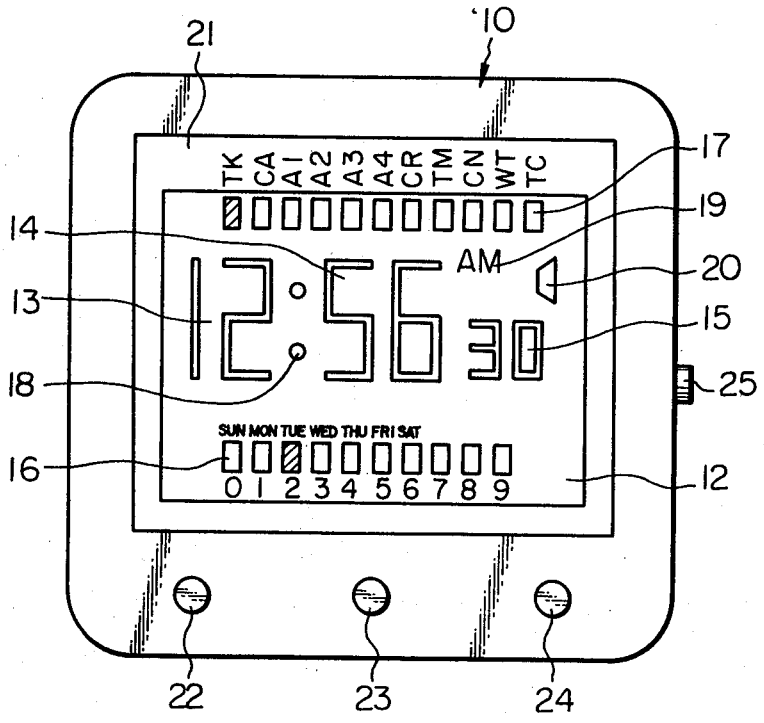
FIG. 1 is a schematic view of a multi-function timepiece in accordance with the present invention.

FIG. 1 shows the external appearance of a multi-function timepiece in accordance with the invention. Reference numeral 10 denotes the timepiece itself, and reference numeral 12 designates a digital display section which includes a 1st display section 13, 2nd display section 14 and 3rd display section 15 all of which are constituted by numerical display patterns, a 4th display section 16 constituted by a pattern of 10 marks, a function display section 17 constituted by a pattern of 11 marks, a seconds colon 18, an AM-FM display section 19, and an alarm mark 20. A series of numbers from 0 to 9 are printed alongside the 10 corresponding marks which constitutes the 4th display section 16, and characters representing the days of the week are printed alongside the first seven of these marks beginning from the left-hand side of the timepiece. Further, initial marks which indicate the type of function displayed by the function display section 17 are printed on a partitioning plate 21 alongside the marks which constitute display section 17. Thus, beginning from the left-hand side of the timepiece, the respective marks are provided with initials indicative of time-keeping (TK), calendar (CA), 1st alarm (A1), 2nd alarm (A2), 3rd alarm (A3), 4th alarm (A4), chronograph (CR), timer (TM), counter (CN), world-time (WT), and time change (TC), respectively. The timepiece is in the state of operation as indicated by the illuminated mark. Accordingly, FIG. 1 shows that the timepiece is in the time-keeping mode since the mark corresponding to TK is illuminated.

The 4th display section 16 normally indicates the day of the week by means of the first seven marks and corresponding characters; however, when the chronograph mode is selected, the ten marks indicate time in units of 1/10 second each.

Reference numberal 22 denotes a function selection button for selecting the available functions, reference numeral 23 designates a digit selection button for selecting the display sections, reference numeral 24 denotes a correction button for correcting or setting the content displayed in the display section selected by digit selection button 23, and reference numeral 25 designates a function control button for controlling each of the functions selected by function selection button 22.

Figures 2, 2A:
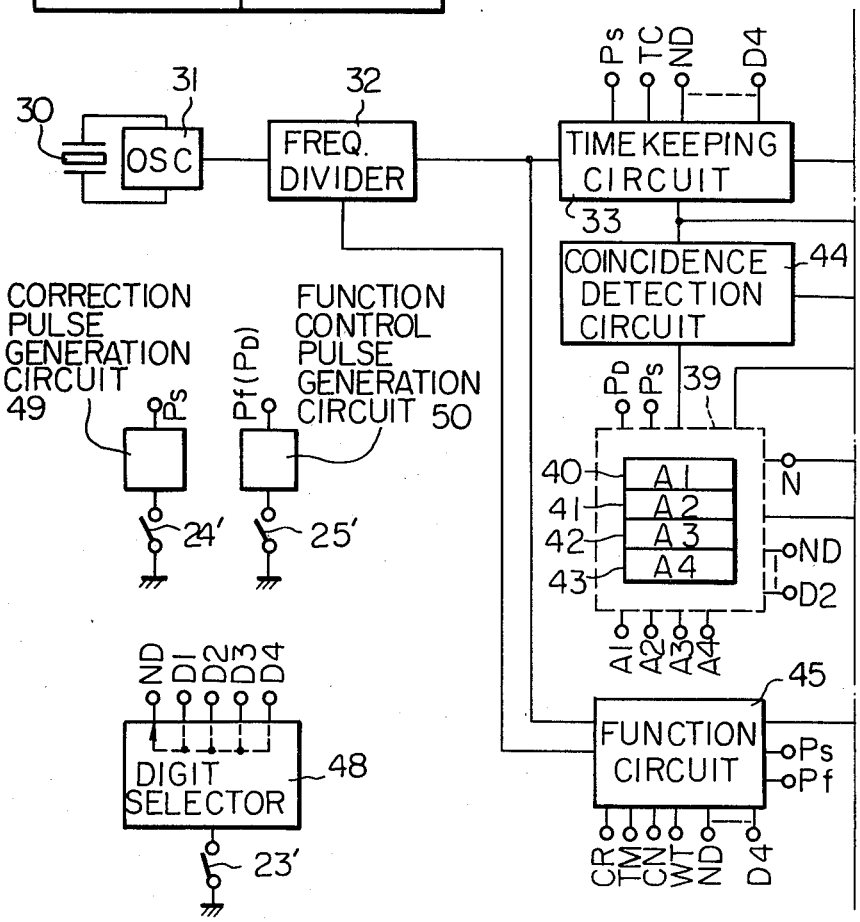
FIG. 2 is a schematic view showing the relationship of FIGS. 2A and 2B.
FIGS. 2A and 2B are block diagrams showing the wiring of the timepiece shown in FIG. 1.
Figure 2B:
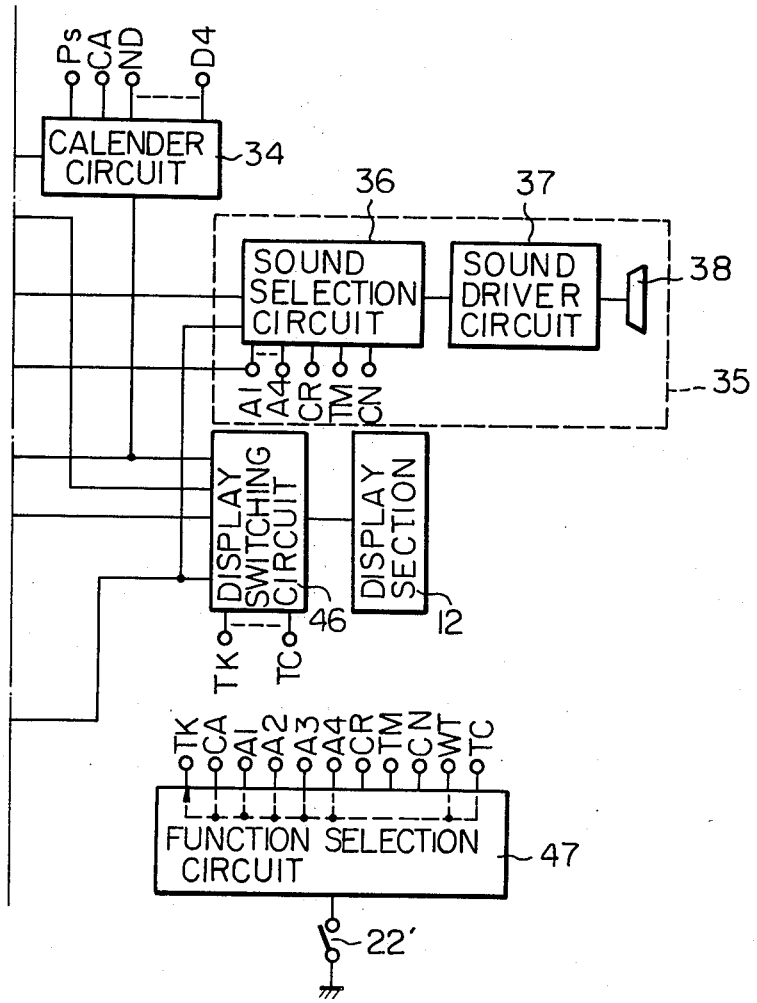

FIGS. 2A and 2B are block diagrams of a detailed electric circuitry for the timepiece of FIG. 1. Reference numeral 30 denotes a quartz controlled oscillator, 31 an oscillator circuit, 32 a frequency divider, 33 a time-keeping circuit comprising hours, minutes and seconds counters, and 34 a calendar circuit comprising months, date and days of the week counters. These circuits define a widely known time-keeping device.

Reference numeral 35 denotes a sound generator which comprises a sound selection circuit 36, sound driver circuit 37, and a buzzer 38. Reference numeral 39 designates an alarm memory device which comprises a 1st memory 40, 2nd memory 41, 3rd memory 42 and 4th memory 43. Each of these memories can be set for one-time memory function or periodic memory function.

Reference numeral 44 denotes a coincidence detection circuit which, by producing a coincidence signal whenever the time set in the memories of the alarm memory device 39 is in coincidence with the time kept by the time-keeping circuit 33, drives sound generator 35 thereby to generate an alarm.

Reference numeral 45 denotes function circuit means which, in the present embodiment, makes it possible to switch between the chronograph, timer, counter and world-time functions.

Reference numeral 46 designates a display switching circuit for switching the contents of time-keeping circuit 33, calendar circuit 34, alarm memory circuit 39 and function circuit means 45 to digital display section 12 in order to permit the contents to be displayed.

Reference numeral 47 denotes a function selection circuit which, in response to an operation signal supplied by a function selection switch 22' controlled by the function selection button 22, selectively designates in a successive manner the function terminals TK through TC corresponding to function display section 17. After the elapse of a given period of time following the designation of any of the functions CA, A1, A2, A3, A4, WT and TC, the TK function is restored as shown by the dotted line.

Reference numeral 48 denotes a digit selection circuit which, in response to an operation signal supplied by a digit selection switch 23' controlled by the digit selection button 23, selectively designates in a successive manner the digit selection electrodes D1 through D4 corresponding to each display section of digital display section 12. After the elapse of a given period of time following designation of any of the selection positions, the normal display position ND is restored as shown by the dotted line. When the normal display electrode ND is designated, all of the display sections which constitute digital display section 12 are in a normal state of display; however, when terminal D1 is designated, 1st display section 13 is placed in a state which is capable of correction as will be indicated when the display section begins to flash. Similarly, 2nd display section 14, 3rd display section 15, and 4th display section 16 may be placed in states awaiting correction by designating the respective terminals D2, D3 and D4.

Reference numeral 49 denotes a correction pulse generating circuit which, by generating a correction pulse Ps for each operation of correction switch 24' as controlled by the correction button 24, either corrects or sets the display content of the display section designated by digit selection circuit 48.

Reference numeral 50 denotes a function control pulse generating circuit which, by generating a function control pulse Pf for each operation of function control switch 25' as controlled by function control button 25, controls each function selected by function selection circuit 47.

The output terminals of function selection circuit 47, digit selection circuit 48, correction pulse generating circuit 49 and function control pulse generating circuit 50 are connected to each of the circuit means as shown in the drawing. The output terminals of function selection circuit 47 govern display switching circuit 46 which switches to the function to be displayed, designate the operational modes of function circuit means 45, alarm memory means 39, time-keeping circuit 33 and calendar circuit 34, and allow sound selection circuit 36 to generate a different alarm for each function. Further, the digits to be corrected for the world-time function with respect to time-keeping circuit 33, calendar circuit 34 and function circuit means 45 are designated by the outputs appearing at the output terminals of digit selection circuit 48. These outputs also designate the digits to be set in each memory of the alarm memory means 39 and in the timer function of the function display means 45.

Figure 3:
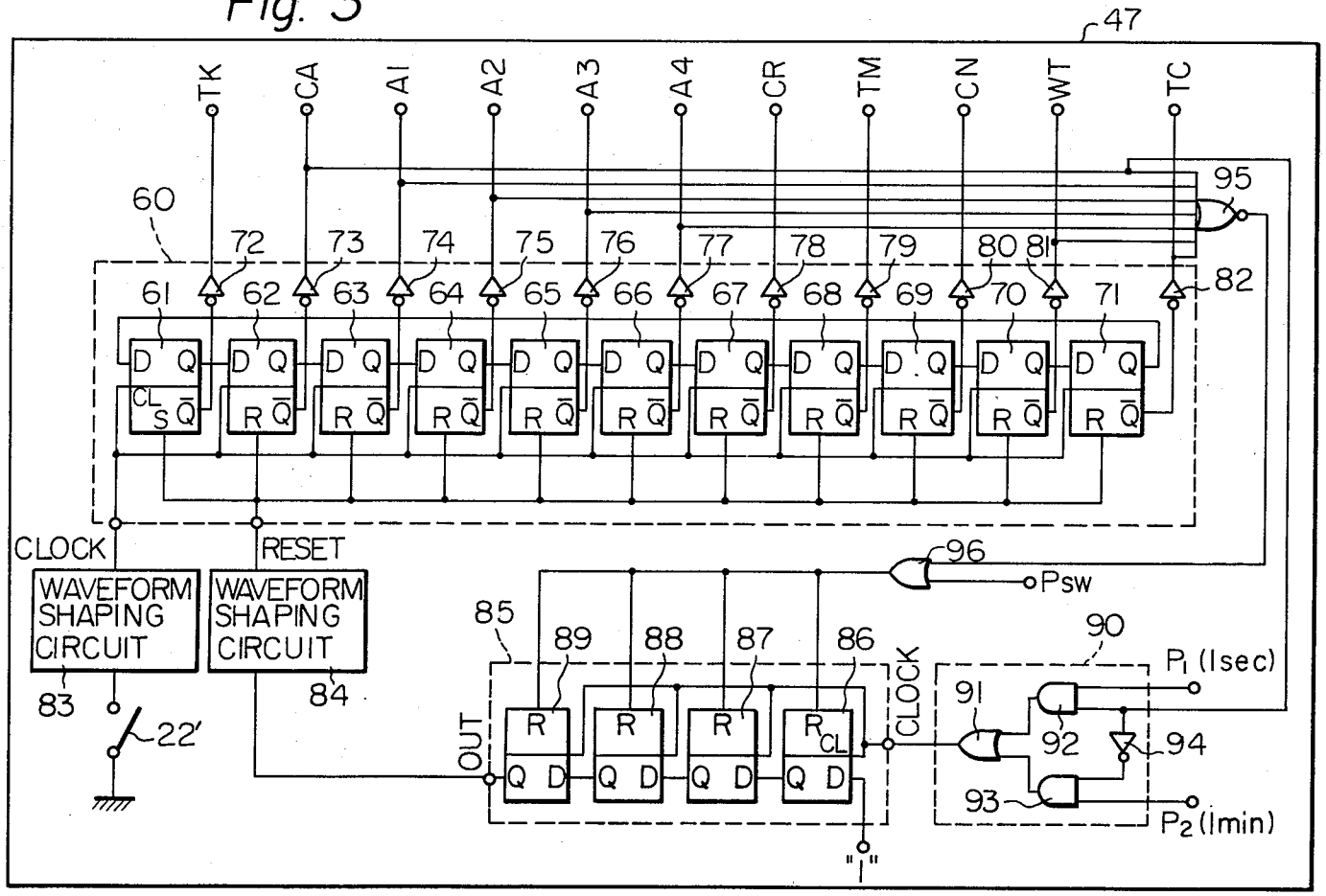
FIG. 3 is a detailed circuitry for the function selection circuit shown in FIGS. 2A and 2B.

FIG. 3 shows a detailed circuitry for the function selection circuit 47. The function selection circuit 47 comprises a shift register 60 composed of eleven data-type flip-flops 61 through 71 and inverters 72 through 81 connected to the $\overline{Q}$ outputs of the data-type flip-flops 61 through 71, respectively. The outputs of the inverters 72 through 81 are connected to terminals TK through TC, respectively. The Q output of each of the data-type flip-flops is connected to the data input terminal of each of subsequent stages of the flip-flops. The clock input terminals of the flip-flops 61 through 71 are commonly connected through a waveform shaping circuit 83 to the function selection switch 22'. The set terminal of the flip-flop 61 and the reset terminals of the other flip-flops 62 through 71 are coupled together and connected through a waveform shaping circuit 84 to a timer circuit 85. The timer circuit 85 is composed of data-type flip-flops 86 through 89. The data input terminal of the flip-flop 89 is maintained at a high logic level at all times and, therefore, when the reset terminals of the flip-flops 86 through 89 are released, the logic states are consecutively shifted by clock pulses applied to a clock terminal denoted as CLOCK. Thus, the timer circuit 85 generates an output in response to a fourth clock pulse, which output is applied through the waveform shaping circuit 84 to the reset terminal of the shift register 60 in which the flip-flop 61 is set and the other flip-flops are all reset. Connected to the clock terminal of the timer circuit 85 is a clock pulse switching circuit 90, which is composed of an OR gate 91, AND gates 92 and 93, and an inverter 94. One input of the AND gate 92 is connected to a terminal P1 to which clock pulses of one second cycle are applied. The other input of the AND gate 92 is connected to the terminal CA, i.e., the output of the inverter 73 to which one input of the AND gate 93 is connected through the inverter 94. The other input of the AND gate 93 is connected to a terminal P2 to which clock pulses of one minute cycle are applied. Outputs of the AND gates 92 and 93 are connected to inputs of the OR gate 91, whose output is connected to the clock terminal of the timer circuit 85. With this arrangement, the clock pulse switching circuit 90 selectively applies one of the clock pulses P1 and P2 to the timer circuit 85 in dependence on the logic state of the terminal CA.

Designated at 95 is a NOR gate having inputs coupled to the output terminals CA, A1, A2, A3, A4, WT and TC and an output coupled to one input of an OR gate 96 having its output coupled to the reset terminals of the timer circuit 85. The other input of the OR gate 96 is connected to a terminal Psw, to which switch pulses generated by the operations of digit selector switch 23' and correction switch 24' are supplied to effect resetting of the flip-flops of the timer circuit 85. Either one of the output terminals CA, A1, A2, A3, A4, WT and TC goes to a high logic level, the output of the NOR gate 95 goes to a low logic level, releasing the reset terminals of the flip-flops of the timer circuit 85.

The operation of the electronic timepiece constructed as described above will now be described with respect to each available function.

For the 1st function, i.e., the time-keeping function, function selection circuit 47 designates terminal TK so that the content of time-keeping circuit 33 is selected and switched to digital display section 12 by means of the display switching circuit 46. Thus, as shown in FIG. 1, only the mark corresponding to TK of display section 17 is illuminated thereby indicating that the timepiece is in the time-keeping mode. At the same time, hours are displayed in the 1st display section 13, minutes in the 2nd display section 14, seconds in the 3rd display section 15, and the day of the week in the 4th display section 16. In this state, the output of the NOR gate 95 is held at a high logic level and, therefore, the timer circuit 85 is maintained in its reset condition.

The 2nd function, i.e., the calendar, is designated by a single operation of function selection button 22. In other words, function selection circuit 47 designates terminal CA in response to operation of the function selection switch 22' so that display switching circuit 46 selects the content of calendar circuit 34. As a result, only the mark corresponding to CA of function display section 17 is illuminated, while months are displayed in the 1st display section 13, the date is displayed in the 2nd display section 14, years in the 3rd display section 15, and the day of the week in the 4th display section 16. In this state, calendar circuit 34 is in the designated state due to the output at terminal CA of the function selection circuit 47 so that operation of digit selection button 23 allows selection of any one of the output terminals D1, D2, D3 or D4 of digit selection circuit 48, whereby calendar circuit 34 is controlled so as to select the months, date, years and days of the week digits in a successive manner. The display section which has been placed in the selected state can be corrected by operating the correction button 24. When the calendar mode is selected, the output terminal CA goes to a high logic level and the output of the NOR gate goes to a low logic level. This output is applied through the OR gate 96 to the timer circuit 85, releasing the reset condition. In this instance, since the AND gate 92 is open by the output terminal CA, the clock pulses of one second cycle are supplied through the OR gate 91 to the clock terminal of the timer circuit 85, which consequently commenses its operation. Accordingly, the timer circuit 85 generates an output signal after four seconds have passed. This output signal is applied through the waveform shaping circuit 84 to the reset terminal of the shift register 60. Under this condition, the flip-flop 61 is set and the remaining flip-flops 62 through 71 are reset whereby the time-keeping mode is forcibly provided.

For the 3rd function, i.e., the alarm, four memories A1 though A4 can be set. The memories are designated successively starting from A1 by means of function selection button 22, this being indicated by illumination of the proper mark in function display section 17. At the same time, hours are displayed in 1st display section 13, and minutes in 2nd display section 14. In addition, AM-PM mark 19 and alarm mark 20 are displayed. In this state, the digits which appear in 1st display section 13 and 2nd display section 14 are selected by digit selection button 23, and the desired time is set by correction button 24. When the time set in the memories of alarm memory means 39 is in coincidence with the time kept by time-keeping circuit 33, coincidence detection circuit 44 generates a coincidence signal which causes sound generator 35 to produce an alarm. Moreover, a different alarm for each of the alarm functions A1 through A4 is produced in response to the operation alarm signal designated by sound selection circuit 36 which is responsive to alarm memory means 39. Further, each of the memories of the alarm memory means 39 can be assigned modes of operation whereby individual memories will operate to provide an alarm only once, or where they will operate daily at the designated time. These two modes are designated as follows. When the alarm function has been designated, a function control pulse Pf, produced by function control pulse generating circuit 50 is response to operation of the function control button, is applied as a mode designation signal to the mode designation terminal $P_D$ of alarm memory means 39. The state of the mode so designated is indicated by the alarm display mark 20: the mark is displayed in a normal manner for the single operation mode and flashes to indicate the fixed operation mode. Accordingly, the fixed operation mode may conveniently be selected to produce an alarm at a specified time every day. For example, an alarm can be set to awaken the user in the morning or to notify an individual of a daily departure time. It is also possible to distribute the two modes among the four alarm functions. In the present embodiment, by connecting the signal from calendar circuit 34 to the terminal N of alarm memory means 39, the fixed operation mode is set not to operate only on Sunday. It is to be noted that when the A1 mode is selected, the output of the NOR gate 95 goes to a low logic level and the timer circuit 85 starts to operates. Since, in this instance, the AND gate 93 is open by the action of the inverter 94, the clock pulses of one minute cycle are applied to the timer circuit, which consequently generates an output signal after four minutes have elapsed. Thus, the shift register 61 is set and the time-keeping mode is selected. During the A1 memory mode, if the digit selection switch 23' and the correction switch 24' are actuated to set an alarm time, the switch pulses Psw generated by the operations of the switches 23' and 24' are applied through the OR gate 96 to the reset terminal of the timer circuit 85, instaneously resetting this timer circuit. Consequently, the timer circuit 85 repeats counting and resetting operations during the alarm mode and generates an output signal to return the shift register 60 to its time-keeping mode when four minutes have passed after the final operation of each of the switches 23' and 24'.

For the 4th function, i.e., the chronograph, function circuit means 45 is set to the chronograph function, and digital display section 12 is utilized to display hours in 1st display section 13, minutes in 2nd display section 14, seconds in 3rd display section 15, and tenths of seconds in 4th display section 16. The display is started and stopped by operating function control button 25, and set to zero by correction button 24. Further, sound generator 35 will produce an audible sound for each start and stop operation and for every 1-second count.

For the 5th function, i.e., the timer, function circuit means 45 is set to the timer function (subtraction mode), and digital display section 12 is utilized to display hours in 1st display section 13, minutes in 2nd display section 14, seconds in 3rd display section 15, and tenths of seconds in 4th display section 16. The time shown in each display section is set by means of digit selection button 23 and correction button 24, and the timer is started by operating function control button 25. Sound generator 35 will produce an alarm when the timer is started and stopped.

For the 6th function, i.e., the counter, function circuit means 45 is set to the counter function (the counting circuits including divide-by-six and divide-by-10 counters), and the digital display section 12 makes combined use of 1st display section 13 and 2nd display section 14 as a 4-digit counter. (By converting the counting circuit corresponding to the 2nd display section 14 from a divide-by-60 counter to a divide-by-100 counter, it is possible to construct a counter capable of counting to 1200.) This function is operated as was the chronograph function, with the function control button 25 serving as a counting button and the correction button 24 serving as a zero reset button. Confirmation of the counting procedure is available since the sound generator will produce an audible sound each time the counting button 25 is depressed.

For the 7th function, i.e., world-time, function circuit means 45 is set to the normal time-keeping function and digital display section 12 is utilized to display hours in 1st display section 13, minutes in 2nd display section 14, and seconds in 3rd display section 15. After setting time-keeping circuit 33 to a time differing by a specific time difference, this being accomplished by manipulating digit selection button 23 and correction button 24, the time-keeping operation is performed in response to a time-keeping signal $\phi$ which is the input signal of the time-keeping circuit 33. Further, with regard to the time-change function, each display section of digital display section 12 is in a state identical to that of the time-keeping state. However, since in this case the time-keeping circuit 33 has been placed in the correction state due to the output which appears at terminal TC of function selection circuit 47, a time correction can be performed by manipulating digit selection button 23 and correction button 24. Moreover, for functions other than the chronograph, timer and counter functions mentioned above, a priority system has been adopted which returns the timepiece to the time-keeping function after a given amount of time has elapsed. In addition, since the time-keeping function, alarm function as well as the other functions are operated independently of the other, an audible alarm can be produced at the designated time regardless of the function which has been selected. It is also possible to distinguish among alarms since a different sound can be produced for each function.

It should thus be appreciated from the above description that the present invention is constructed of three blocks, namely means for a time-keeping function, alarm function and other functions, and that each of these functions is operable independely of the other. Consequently, while the 1st and 2nd functions, i.e., the time-keeping and alarm functions, are given priority, a function circuit which possesses the capability of furnishing additional functions operates in a comparatively non-continuous manner thereby allowing these other functions to be switched to and displayed for a given period of time. This thus makes it possible to provide the most effective system for a multi-function timepiece. Further, utilizing the sound generator of the alarm function means in the other functions, enhances the effectiveness of these additional functions.

Although the present embodiment makes use of a single digital display device for the purpose of providing a display for all of the functions, a main display device and auxiliary display device can be adopted, wherein the main display device provides a normal time-keeping display while the auxiliary device provides a switched display for the other functions as well as a priority display for the alarm function.

The function selection circuit is arranged such that when a predetermined time interval has elapsed after some of the functions have been selected the function selection circuit is automatically shifted to its initial function mode, i.e., a time-keeping mode. In addition, the timer circuit of the function selection circuit serves as a timer having a long operation time interval when an alarm or time correction modes are selected, and serves as a timer having a short operation time interval when a calendar mode is selected. Since, further, the time correction function mode is arranged to be selected at a final position of a sequence of the function modes, an erroneous operation of the timepiece due to undesireble depression of the time correction button is satisfactorily prevented. While a description has been omitted hereinbefore, it should be desired that a correction of calendar time be continuously performed when the function selection circuit selects the time correction function mode TC.

While the present invention has been shown and described with reference to a particular embodiment by way of example, it should be noted that any other changes or modifications may be made without departing from the scope of the present invention.

What is claimed is:

1. A multi-function electronic timepiece having a standard frequency oscillator, a frequency divider coupled to said standard frequency oscillator, a timekeeping circuit coupled to an output of said frequency divider for providing time information signals, and display means responsive to said time information signals for displaying time information, comprising:

an externally actuated function switch;

function selection circuit means coupled to said function switch and responsive to successive actuations thereof for producing function selection signals in a predetermined sequence from a plurality of output terminals of said function selection circuit means; and function circuit means responsive to each of said function selection signals for controlling said electronic timepiece to operate in a corresponding one of a plurality of function modes including at least a timekeeping mode, a chronograph mode and a time correction mode;

wherein, when said function switch is actuated while the electronic timepiece is in said timekeeping mode, said function selection circuit means is responsive to a plurality of subsequent actuations of said function switch for producing function selection signals designating at least one function mode other than said time correction mode before a function selection signal designating said time correction mode is produced by said function selection circuit means in said predetermined sequence.

2. A multi-function electronic timepiece according to claim 1, in which said display means further comprises a plurality of display marks for indicating the selection of each of said function modes.

3. A multi-function electronic timepiece according to claim 1, in which said time correction mode is selected at a final step in said predetermined sequence.

4. A multi-function electronic timepiece according to claim 1, in which said function selection circuit means comprises a shift register circuit.

5. A multi-function electronic timepiece according to claim 1, and further comprising a timer circuit coupled to said function selection circuit means, for returning said function selection circuit means to a condition in which a timekeeping mode function selection signal is generated by said function selector circuit means, when a predetermined time has elapsed after selection of a function mode other than said timekeeping mode.

6. A multi-function electronic timepiece according to claim 5, and further comprising means for controlling said timer circuit to selectively provide at least two different values of said predetermined time lapse in accordance with the function mode selected.

7. A multi-function electronic timepiece according to claim 6, in which said timer circuit control means comprises gate means coupled to receive first and second trains of clock pulses of mutually different frequencies, said gate means being responsive to at least one of said function selection signals for selectively applying said first and second trains of clock pulses to said timer circuit for thereby selectively providing two different values of said predetermined time lapse.

8. A multi-function electronic timepiece according to claim 1, in which said plurality of function modes further comprises a calendar mode.

9. A multi-function electronic timepiece according to claim 1, in which said plurality of function modes further comprises at least one alarm time mode.

10. A multi-function electronic timepiece according to claim 1, in which said plurality of function modes further comprises a timer mode.

11. A multi-function electronic timepiece comprising, in combination:

a standard frequency oscillator;

a frequency divider coupled to said standard frequency oscillator;

a timekeeping circuit coupled to an output of said frequency divider for providing time information signals;

display means responsive to said time information signals for displaying time information;

an externally actuated correction switch;

correction pulse generation circuit means coupled to said correction switch for producing a correction signal in response to actuation of the correction switch, said correction signal being applied to said timekeeping circuit;

an externally actuated digit selector switch;

digit selector circuit means coupled to said digit selector switch and responsive to actuation thereof for producing a plurality of digit selection signals applied to said timekeeping circuit for thereby selecting individual digits of said time information to be corrected by said correction signal;

an externally actuated function switch;

function selection circuit means coupled to said function switch and responsive to successive actuations thereof for producing function selection signals in a predetermined sequence from a plurality of output terminals of said function selection circuit means; and function circuit means responsive to each of said function selection signals for controlling said electronic timepiece to operate in a corresponding one of a plurality of function modes including at least a timekeeping mode, a chronograph mode and a time correction mode;

wherein, when said function switch is actuated while the electronic timepiece is in said timekeeping mode, said function selection circuit means is responsive to a plurality of subsequent actuations of said function switch for producing function selection signals designating at least one function mode other than said time correction mode before a function selection signal designating said time correction mode is produced by said function selection circuit means in said predetermined sequence.

* * * * *